US007507481B2

(12) United States Patent
Hamaya et al.

(10) Patent No.: US 7,507,481 B2
(45) **Date of Patent: *Mar. 24, 2009**

(54) HEAT RESISTANT COATED MEMBER, MAKING METHOD, AND TREATMENT USING THE SAME

(75) Inventors: Noriaki Hamaya, Takefu (JP); Masaru Konya, Takefu (JP); Noboru Yamamoto, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 747 days.

This patent is subject to a terminal disclaimer.

(21) Appl. No.: 10/715,473

(22) Filed: Nov. 19, 2003

(65) Prior Publication Data

US 2004/0110016 A1 Jun. 10, 2004

(30) Foreign Application Priority Data

| | | |
|---|---|---|
| Nov. 20, 2002 | (JP) | 2002-336769 |
| Dec. 9, 2002 | (JP) | 2002-356171 |
| Mar. 28, 2003 | (JP) | 2003-089797 |

(51) Int. Cl.
*B32B 9/00* (2006.01)

(52) U.S. Cl. ..... 428/469; 428/472; 428/701; 428/702; 428/698

(58) Field of Classification Search ..... None
See application file for complete search history.

(56) References Cited

U.S. PATENT DOCUMENTS

| | | | | |
|---|---|---|---|---|
| 4,996,117 | A | 2/1991 | Chu et al. | |
| 5,695,883 | A | 12/1997 | Harada et al. | |
| 5,993,970 | A | 11/1999 | Oscarsson et al. | |
| 6,063,435 | A | 5/2000 | Schulz et al. | |
| 6,159,610 | A | 12/2000 | Paranthaman et al. | |
| 6,733,843 | B2 | 5/2004 | Tsukatani et al. | |
| 2003/0017338 | A1 * | 1/2003 | Takai et al. | 428/408 |

FOREIGN PATENT DOCUMENTS

| | | | |
|---|---|---|---|
| EP | 1178129 | A1 | 2/2002 |
| EP | 1 239 055 | A2 | 9/2002 |
| EP | 1243666 | A1 | 9/2002 |
| EP | 1 247 786 | A1 | 10/2002 |
| JP | 60-141103 | U | 9/1985 |
| JP | 3-277764 | | 12/1991 |
| JP | 5-70268 | A | 3/1993 |
| JP | 05-271900 | | 10/1993 |
| JP | 5-320860 | A | 12/1993 |
| JP | 6-65745 | A | 3/1994 |
| JP | 6-73522 | A | 3/1994 |
| JP | 07-033559 | | 2/1995 |
| JP | 2000-94090 | A | 4/2000 |
| JP | 2000-509102 | A | 7/2000 |
| JP | 2000-281469 | | 10/2000 |
| JP | 2002-80954 | A | 3/2002 |
| JP | 2002-104892 | | 4/2002 |
| JP | 2002-332559 | A | 11/2002 |
| JP | 2003-73794 | | 3/2003 |
| JP | 2003-82402 | | 3/2003 |

* cited by examiner

*Primary Examiner*—Timothy M Speer
(74) *Attorney, Agent, or Firm*—Birch, Stewart, Kolasch & Birch, LLP

(57) ABSTRACT

A coated member comprising a substrate of Mo, Ta, W, Zr or carbon and a coating of rare earth-containing oxide including a surface layer having a Vickers hardness of at least 50; or a coated member comprising a substrate having a coefficient of linear expansion of at least $4\times10^{-6}$ (1/K) and a coating of rare earth-containing oxide thereon is heat resistant and useful as a jig for use in the sintering of powder metallurgical metal, cermet and ceramic materials.

18 Claims, No Drawings

HEAT RESISTANT COATED MEMBER, MAKING METHOD, AND TREATMENT USING THE SAME

This Nonprovisional application claims priority under 35 U.S.C § 119(a) on Patent Application No(s). 2002-336769, 2002-356171 and 2003-089797 filed in Japan on Nov. 20, 2002, Dec. 9, 2002 and Mar. 28, 2003, respectively, the entire content of which are hereby incorporated by reference.

BACKGROUND OF THE INVENTION

1. Technical Field

This invention relates to a heat resistant coated member which is used in the sintering or heat treatment of powder metallurgical metal, cermet or ceramic materials in vacuum or an inert or reducing atmosphere; a method for preparing the same; and a method for the heat treatment of powder metallurgical metal, cermet or ceramic materials using the coated member.

2. Background Art

Powder metallurgy products are generally manufactured by mixing a primary alloy with a binder phase-forming powder, then kneading the mixture, followed by compaction, sintering and post-treatment. The sintering step is carried out in a vacuum or an inert gas atmosphere, and at an elevated temperature of 1,000 to 1,600° C.

In a typical cemented carbide manufacturing process, solid solutions of tungsten carbide with cobalt, titanium carbide, and tantalum carbide are comminuted and mixed, then subjected to drying and granulation to produce a granulated powder. The powder is then pressed, following which such steps as dewaxing, pre-sintering, sintering and machining are carried out to give the final cemented carbide product.

Sintering is carried out at or above the temperature at which the cemented carbide liquid phase appears. For example, the eutectic temperature for a ternary WC—Co system is 1,298° C. The sintering temperature is generally within a range of 1,350 to 1,550° C. In the sintering step, it is important to control the atmosphere so that cemented carbide correctly containing the target amount of carbon may be stably sintered.

When cemented carbide is produced by sintering at about 1,500° C., green specimens placed on a carbon tray often react with the tray. That is, a process known as carburizing occurs, in which carbon from the tray impregnates the specimen, lowering the strength of the specimen. A number of attempts have been made to avoid this type of problem, either by choosing another type of tray material or by providing on the surface of the tray a barrier layer composed of a material that does not react with the green specimen. For example, ceramic powders such as zirconia, alumina and yttria are commonly used when sintering cemented carbide materials. One way of forming a barrier is to scatter the ceramic powder over the tray and use it as a placing powder. Another way is to mix the ceramic powder with a solvent and spray-coat the mixture onto the tray or apply it thereto as a highly viscous slurry. Yet another way is to form a coat by using a thermal spraying or other suitable process to deposit a dense ceramic film onto the tray. Providing such an oxide layer as a barrier layer on the surface of the tray has sometimes helped to prevent reaction of the tray with the specimen.

In general, the powder metallurgy or ceramic manufacturing process involves firing or sintering and heat treatment steps. The specimen that is to become a product is set on the tray. Since the specimen can react with the tray material to invite a deformation or compositional shift or introduce impurities into the product, there are many cases where products are not fired or sintered in high yields. There are many ways for preventing the reaction of the tray with the product, as described above. For example, an oxide powder such as alumina or yttria or a nitride powder such as aluminum nitride or boron nitride is used as the placing powder. Alternatively, such an oxide or nitride powder is mixed with an organic solvent to form a slurry, which is coated or sprayed to the tray to form a coating on the tray for preventing the tray from reacting with the product. On use of placing powder, however, some of the placing powder will deposit on the product. The slurry coating procedure must be repeated every one or several sintering steps because the coating peels from the substrate (tray).

To solve these problems, JP-A 2000-509102 proposes to form a dense coating on the surface of a tray by a thermal spraying technique. Specifically, when a graphite tray is used in the sintering of materials to produce cemented carbides or cermets, the graphite tray is coated with a cover layer made of $Y_2O_3$ containing up to 20% by weight of $ZrO_2$ or an equivalent volume of another heat resistant oxide such as $Al_2O_3$ or a combination thereof, and having an average thickness of at least 10 μm.

Although the thermally sprayed coating of this patent publication is effective for preventing reaction with the product, there is a likelihood that the coating readily peels off due to thermal degradation at the interface between the coating and the tray substrate by repeated thermal cycling. It is thus desired to have a coated member in which the oxide coating does not peel from the substrate even when subjected to repeated thermal cycling, that is, having heat resistance, corrosion resistance, durability and non-reactivity.

More particularly, even when a barrier layer is formed on a carbon tray, reaction can occur between the barrier layer and the tray. After one or a few sintering cycles, the barrier layer cracks, fragments and spalls off. Peeling of the coating allows for reaction between the carbon tray and a specimen. During the sintering step, the coating can peel and fragment into pieces which are often introduced into the specimen. Then a fresh coated tray must be used.

For the above-described reason, there is a need for a tray having a long lifetime in that when used in sintering, the barrier layer does not react with a specimen or with the tray substrate or peel off, and when used in the sintering of powder metallurgical products, the barrier layer does not react with specimens or peel from the tray substrate even after repeated use.

SUMMARY OF THE INVENTION

An object of the present invention is to provide a coated member which exhibits excellent heat resistance, corrosion resistance, and non-reactivity when used in the sintering or heat treatment of powder metallurgical metal, cermet or ceramic materials in vacuum or an inert or reducing atmosphere. Another object is to provide a method for preparing the coated member. A further object is to provide a method of heat treatment using the coated member.

It has been found that a heat resistant coated member in which a substrate of a material selected from among Mo, Ta, W, Zr, and carbon is coated with a rare earth-containing oxide exhibits excellent heat resistance, corrosion resistance, and non-reactivity when used in the sintering or heat treatment of a powder metallurgical metal, cermet or ceramic material in vacuum or an inert or reducing atmosphere. When a surface layer of the rare earth-containing oxide coating has a hardness of at least 50 HV in Vickers hardness, the separation of the oxide coating from the substrate is prohibited. When the surface layer has a surface roughness of up to 20 μm in centerline average roughness Ra, the coated member is more effective for preventing a ceramic product from deformation during sintering or heat treatment thereon.

It has also been found that a heat resistant coated member in which a substrate having a coefficient of linear expansion of at least $4\times10^{-6}$ (1/K) is coated with a rare earth-containing oxide exhibits heat resistance, durability (the coating scarcely peels off upon repeated thermal cycling) and non-reactivity to a product, when used in the sintering or heat treatment of a powder metallurgical metal, cermet or ceramic material in vacuum or an inert or reducing atmosphere.

It has further been found that a heat resistant coated member in which a heat resistant substrate is coated with a layer of a specific composition comprising a complex oxide of a lanthanoid element and a Group 3B element such as Al, B or Ga exhibits heat resistance, durability (the coating scarcely peels off upon repeated thermal cycling), non-reactivity to a product and anti-sticking, when used in the sintering or heat treatment of a powder metallurgical metal, cermet or ceramic material in vacuum or an inert or reducing atmosphere.

In a first embodiment, the present invention provides (1) a heat resistant coated member comprising a substrate made of a material selected from the group consisting of Mo, Ta, W, Zr, and carbon and a coating of rare earth-containing oxide thereon, the rare earth-containing oxide coating including a surface layer having a hardness of at least 50 HV in Vickers hardness.

Also provided are (2) a method for preparing a heat resistant coated member comprising coating a substrate made of a material selected from the group consisting of Mo, Ta, W, Zr, and carbon with a rare earth-containing oxide, and heat treating the surface of the coating so that the surface has a hardness of at least 50 HV in Vickers hardness; and (3) a method of heat treating a powder metallurgical metal, cermet or ceramic material, comprising the steps of placing the material on the heat resistant coated member of claim 1 and heat treating the material thereon.

In a second embodiment, the present invention provides (4) a heat resistant coated member comprising a substrate having a coefficient of linear expansion of at least $4\times10^{-6}$ (1/K) and a layer comprising, preferably consisting of, rare earth-containing oxide coated thereon.

Preferably the coating layer comprises at least 80% by weight of a rare earth oxide and the balance of another metal oxide which is mixed, combined or laminated therewith. Also preferably, the rare earth oxide is mainly composed of an oxide of at least one element selected from the group consisting of Dy, Ho, Er, Tm, Yb, Lu, and Gd.

In a typical application, the coated member is used in the sintering of a powder metallurgical metal, cermet or ceramic material in vacuum or an inert or reducing atmosphere.

In a third embodiment, the present invention provides the coated members defined below.

(5) A heat resistant coated member comprising a metal, carbon, or carbide, nitride or oxide ceramic substrate; an intermediate coating layer on the substrate comprising a lanthanoid oxide, an oxide of Y, Zr, Al or Si, a mixture of these oxides, or a complex oxide of these elements; and a coating layer on the intermediate coating layer comprising a complex oxide of a lanthanoid element and a Group 3B element.

(6) A heat resistant coated member comprising a metal, carbon, or carbide, nitride or oxide ceramic substrate; an intermediate coating layer on the substrate comprising a lanthanoid oxide, an oxide of Y, Zr, Al or Si, a mixture of these oxides, or a complex oxide of these elements; and a coating layer on the intermediate coating layer comprising a complex oxide of yttrium, an optional lanthanoid element and a Group 3B element.

(7) A heat resistant coated member comprising a metal, carbon, or carbide, nitride or oxide ceramic substrate; an intermediate coating layer on the substrate comprising a metal selected from the group consisting of Mo, W, Nb, Zr, Ta, Si and B, or a carbide or nitride thereof; and a coating layer on the intermediate coating layer comprising a complex oxide of a lanthanoid element and a Group 3B element.

(8) A heat resistant coated member comprising a metal, carbon, or carbide, nitride or oxide ceramic substrate; an intermediate coating layer on the substrate comprising a metal selected from the group consisting of Mo, W, Nb, Zr, Ta, Si and B, or a carbide or nitride thereof; and a coating layer on the intermediate coating layer comprising a complex oxide of yttrium, an optional lanthanoid element and a Group 3B element.

(9) A heat resistant coated member comprising a metal, carbon, or carbide, nitride or oxide ceramic substrate; an intermediate coating layer on the substrate comprising $ZrO_2$, $Y_2O_3$, $Al_2O_3$ or a lanthanoid oxide, a mixture of these oxides, or a complex oxide of Zr, Y, Al or lanthanoid element, and a metal selected from the group consisting of Mo, W, Nb, Zr, Ta, Si and B; and a coating layer on the intermediate coating layer comprising a complex oxide of a lanthanoid element and a Group 3B element.

(10) A heat resistant coated member comprising a metal, carbon, or carbide, nitride or oxide ceramic substrate; an intermediate coating layer on the substrate comprising $ZrO_2$, $Y_2O_3$, $Al_2O_3$ or a lanthanoid oxide, a mixture of these oxides, or a complex oxide of Zr, Y, Al or lanthanoid element, and a metal selected from the group consisting of Mo, W, Nb, Zr, Ta, Si and B; and a coating layer on the intermediate coating layer comprising a complex oxide of yttrium, an optional lanthanoid element and a Group 3B element.

Preferably, the complex oxide of yttrium and a Group 3B element contains up to 80% by weight of $Y_2O_3$ and at least 20% by weight of $Al_2O_3$.

(11) A heat resistant coated member comprising a metal, carbon, or carbide, nitride or oxide ceramic substrate; an intermediate coating layer on the substrate comprising a lanthanoid oxide, an oxide of Y, Zr, Al or Si, a mixture of these oxides, or a complex oxide of these elements; and a coating layer on the intermediate coating layer comprising an oxide of a lanthanoid element, aluminum or yttrium.

(12) A heat resistant coated member comprising a metal, carbon, or carbide, nitride or oxide ceramic substrate; an intermediate coating layer on the substrate comprising a metal selected from the group consisting of Mo, W, Nb, Zr, Ta, Si and B, or a carbide or nitride thereof; and a coating layer on the intermediate coating layer comprising aluminum oxide or a lanthanoid oxide.

More specific embodiments as described below are also provided.

(13) A heat resistant coated member comprising a carbon substrate, an interlayer of $Yb_2O_3$ formed thereon, and a coating layer formed on the interlayer and comprising a complex oxide consisting essentially of up to 80% by weight of $Y_2O_3$ and at least 20% by weight of $Al_2O_3$.

(14) A heat resistant coated member comprising a carbon substrate, an interlayer of $ZrO_2$ formed thereon, and a coating layer formed on the interlayer and comprising a complex oxide consisting essentially of up to 80% by weight of $Y_2O_3$ and at least 20% by weight of $Al_2O_3$.

(15) A heat resistant coated member comprising a carbon substrate, an interlayer of $ZrO_2$ and $Y_2O_3$ formed thereon, and a coating layer formed on the interlayer and comprising a complex oxide consisting essentially of up to 80% by weight of $Y_2O_3$ and at least 20% by weight of $Al_2O_3$.

(16) A heat resistant coated member comprising a carbon substrate, an interlayer of tungsten formed thereon, and a coating layer formed on the interlayer and comprising a complex oxide consisting essentially of up to 80% by weight of $Y_2O_3$ and at least 20% by weight of $Al_2O_3$.

DESCRIPTION OF THE PREFERRED EMBODIMENTS

In the first embodiment of the invention, the heat resistant coated member includes a substrate made of a material selected from among molybdenum Mo, tantalum Ta, tungsten W, zirconium Zr, and carbon C and a layer of rare earth-containing oxide coated thereon. The coated member is intended for use in the sintering or heat treatment of powder metallurgical metals, cermets or ceramics in vacuum or an inert or reducing atmosphere to form a cemented carbide or similar product. It is recommended that the type of substrate, the type of coating oxide, and the combination thereof be varied and optimized in accordance with the product itself and the temperature and gas used in sintering and heat treatment.

The coated member of the invention is particularly effective as crucibles for melting metal or as jigs for fabricating and sintering various types of complex oxides. Examples of such jigs include setters, saggers, trays and molds.

In the invention, the substrate for forming such heat-resistant, corrosion-resistant members used in the sintering or heat treatment of powder metallurgical metals, cermets and ceramics is made of a material selected from among molybdenum, tantalum, tungsten, zirconium, and carbon.

When carbon is used as the substrate, the carbon substrate has a density of preferably at least 1.5 g/cm$^3$, more preferably at least 1.6 g/cm$^3$, and most preferably at least 1.7 g/cm$^3$. Note that carbon has a true density of 2.26 g/cm$^3$. At a substrate density of less than 1.5 g/cm$^3$, although the low density provides the substrate with good resistance to thermal shock, the porosity is high, which makes the substrate more likely to adsorb air-borne moisture and carbon dioxide and sometimes results in the release of adsorbed moisture and carbon dioxide in a vacuum.

When a transparent ceramic such as YAG is sintered, treatment within a temperature range of 1,500 to 1,800° C. in a vacuum, an inert atmosphere or a weakly reducing atmosphere tends to give rise to reactions between the substrate material and the coating oxide and to reactions between the coating oxide and the product on account of the elevated temperature. It is therefore important to select a substrate and coating oxide combination that discourages such reactions from arising. At temperatures above 1,500° C. in particular, when carbon is used in the substrate, aluminum and rare-earth elements tend to form carbides in a vacuum or a reducing atmosphere. Under such conditions, it is desirable to use a coated jig in which a molybdenum, tantalum or tungsten substrate is combined with a rare-earth-containing oxide as the oxide coating.

In this regard, the substrate preferably has a coefficient of linear expansion of at least $4\times10^{-6}$ (1/K). Then the heat resistant coated member in the second embodiment of the invention is defined as comprising a substrate having a coefficient of linear expansion in the range and a layer of rare earth-containing oxide coated thereon.

More specifically, in the second embodiment, a substrate having a coefficient of linear expansion of at least $4\times10^{-6}$ (1/K) is used as the substrate for forming a coated member having heat resistance, corrosion resistance and durability for use in the sintering or heat treatment of powder metallurgical metals, cermets or ceramics. The preferred substrate has a coefficient of linear expansion of $4\times10^{-6}$ to $50\times10^{-6}$ (1/K), more preferably $4\times10^{-6}$ to $20\times10^{-6}$ (1/K). As used herein, the coefficient of linear expansion is a coefficient of thermal expansion of a solid as is well known in the art. It is given by the equation: $\alpha=(1/L_0)\times(dL/dt)$ wherein $L_0$ is a length at 0° C., and L is a length at t° C. It is noted that the coefficient of linear expansion used herein is an average measurement over a temperature range of 20 to 100° C.

Rare earth-containing oxides which are effective as the protective coating for preventing reaction with powder metallurgical products, cermet products or ceramic products generally have a coefficient of linear expansion of $4\times10^{-6}$ to $8\times10^{-6}$ (1/K) in a temperature range of 20 to 400° C. When a coating is formed on a substrate from such a rare earth-containing oxide by a thermal spraying technique, it is important that the coefficient of linear expansion of the substrate be equal to or greater than that of the rare earth-containing oxide coating. Such adjustment restrains the coating from delamination by thermal cycling. This is due to the anchoring effect known in the thermal spraying art.

Selection of a substrate having a higher coefficient of linear expansion than a coating enhances the anchoring effect. It should be understood that the type of substrate material which can be used is limited in certain cases because the melting point and atmosphere resistance of the substrate must also be taken into account depending on the firing or sintering temperature and atmosphere or the heat treating temperature and atmosphere to which powder metallurgical products, cermet products or ceramic products are subjected.

For example, a carbon substrate is a typical substrate to be used in a vacuum atmosphere at 1400 to 1600° C. The carbon substrate is widely used for sintering because it has a low density or a light weight, and a high strength and is easily machinable. When carbon is used as a substrate to be covered with an oxide coating, the substrate should preferably have a coefficient of linear expansion of at least $4\times10^{-6}$ (1/K). If the coefficient of linear expansion is less than $4\times10^{-6}$ (1/K), the anchoring effect becomes weak, with a likelihood for the thermally sprayed coating to peel upon thermal cycling to a high temperature of at least 1400° C.

The coefficient of linear expansion of a carbon substrate is closely related to the density of the carbon substrate and the particle size and crystallinity of primary particles of which the carbon substrate is made. Even when the substrate has a high density, the coefficient of linear expansion varies with the particle size and crystallinity of primary particles of which the substrate is made. Thus, a mere choice of a high density carbon substrate is insufficient because the anchoring effect is weak if the coefficient of linear expansion is less than $4\times10^{-6}$ (1/K), with a likelihood for the thermally sprayed coating to peel upon thermal cycling to a high temperature of at least 1400° C.

When a transparent ceramic such as YAG is sintered, treatment within a temperature range of 1,500 to 1,800° C. in a vacuum, an inert atmosphere or a weakly reducing atmosphere tends to give rise to reactions between the substrate material and the coating oxide and to reactions between the coating oxide and the product on account of the elevated temperature. It is therefore important to select a substrate and coating oxide combination that discourages such reactions from arising. At temperatures above 1,500° C. in particular, when carbon is used in the substrate, aluminum and rare-earth elements tend to form carbides in a vacuum or a reducing atmosphere. Under such conditions, it is desirable to use a coated jig in which a molybdenum, tantalum or tungsten substrate is combined with a rare-earth-containing oxide as the oxide coating.

In the first and second embodiments, the substrate has a density of preferably at least 1.5 g/cm$^3$, and especially 1.7 to 20 g/cm$^3$.

The coated members of the first and second embodiments have a layer of rare earth-containing oxide coated on the substrate. The rare earth-containing oxide used herein is an oxide containing a rare earth element or elements; that is, an element selected from among those having the atomic numbers 57 to 71.

In the coated member of the first embodiment, the substrate is preferably coated with an oxide of at least one rare earth element selected from among Sm, Eu, Gd, Dy, Ho, Er, Tm, Yb, and Lu, more preferably an oxide of Er, Tm, Yb or Lu.

In the coated member of the second embodiment, the substrate is preferably coated with an oxide of at least one rare earth element selected from among Dy, Ho, Er, Tm, Yb, Lu and Gd, more preferably an oxide of Er, Tm, Yb, Lu or Gd. This is because oxides of light to medium rare earth elements ranging from La to Tb undergo transitions in their crystalline structures below 1,500° C., by which transition the coating becomes brittle and liable to peel off to contaminate the product or the apparatus, or some oxides are reactive with carbon.

The oxide coating may consist of one or more rare earth oxides. Alternatively, in the oxide coating, an oxide of a metal selected from Group 3A to Group 8 elements may be mixed, combined or laminated with the rare earth oxide in an amount of up to 20% by weight, and especially up to 18% by weight. More preferably, an oxide of at least one metal selected from among Al, Si, Zr, Fe, Ti, Mn, V, and Y is used.

The rare earth-containing oxide used herein is preferably in the form of particles having an average particle size of 10 to 70 μm. The coated member is preferably prepared by plasma spraying or flame spraying a rare earth-containing material in an inert atmosphere such as argon to deposit a coating of rare earth-containing oxide on the substrate. If necessary, the substrate is surface treated by a suitable technique such as blasting prior to the thermal spraying.

Alternatively, the coated member is prepared by pressing rare earth-containing oxide particles having an average particle size of 10 to 70 μm in a mold to form a preform, heat treating the preform and attaching it to the substrate.

The coating of rare earth-containing oxide has a thickness of 0.02 mm to 0.4 mm, more preferably 0.1 mm to 0.2 mm when it is thermally sprayed. At less than 0.02 mm, there is a possibility that on repeated use of the coated member, the substrate may react with the material being sintered. On the other hand, at more than 0.4 mm, thermal shock within the coated oxide film may cause the oxide to delaminate, possibly resulting in contamination of the product. In case the coated member has the heat treated preform attached to the substrate, the thickness of the oxide layer is not particularly limited though a thickness of 0.3 to 10 mm, especially 1 to 5 mm is preferred.

In the first embodiment, the surface of the oxide coating is preferably heat treated in an oxidizing atmosphere, vacuum or inert gas atmosphere at a high temperature of 1,200 to 2,500° C., more preferably 1,200 to 2,000° C. For example, the surface of the thermally sprayed coating is roasted by an argon/hydrogen plasma flame and at a temperature near its melting point. By this heat treatment, the surface of the coating is partially melted and thus smoothed to a surface roughness of 10 μm or less. With heat treatment below 1,200° C. or without heat treatment, the coating surface may not be smoothed to a desired level of surface roughness. Heat treatment above 2,500° C. or above the melting point of the sprayed coating is undesirable because the oxide coating can be melted or evaporated.

Through the heat treatment, the rare earth-containing oxide coating layer in the form of a preform or thermally sprayed coating is increased in hardness, thereby preventing a product being fired from fusing thereto or preventing the coating from peeling off.

In the coated member of the first embodiment, the rare earth-containing oxide coating includes a surface layer having a hardness of at least 50 in Vickers hardness (HV). Preferably the surface layer has a Vickers hardness of at least 80, more preferably at least 100, even more preferably at least 150. The upper limit of Vickers hardness is not critical, but is generally up to 3000, preferably up to 2500, more preferably up to 2000, even more preferably up to 1500. With too low a surface hardness, when a material on the coated member is fired, the material being fired fuses to the rare earth-containing oxide coating so that a surface portion of the rare earth-containing oxide coating can eventually be stripped or torn off. With too high a surface hardness, the rare earth-containing oxide coating layer may crack.

Preferably, the surface layer of the oxide coating has a surface roughness of up to 20 μm in centerline average roughness Ra. In the case of a thermally sprayed coating, a surface roughness (Ra) in the range of 2 to 20 μm, especially in the range of 3 to 10 μm is preferred for effective sintering of a material thereon. At a surface roughness of less than 2 μm, the coating layer is so flat that this may interfere with sintering shrinkage by the material resting thereon. A surface roughness of more than 20 μm may allow the material to deform during the sintering.

When the preform of rare earth-containing oxide particles is heat treated and attached to the substrate to construct the coated member, the heat treated preform has a very high hardness which permits a powder metallurgical metal, cermet or ceramic material to be effectively sintered on the coated member independent of its surface roughness.

It is also possible that an oxide be thermally sprayed to form an oxide coating having a surface roughness (Ra) of at least 2 μm, which is optionally surface worked as by polishing.

In the third embodiment, the heat resistant coated member includes a substrate which is coated with a specific layer, typically a layer of a complex oxide of yttrium or a lanthanoid element and a Group 3B element.

The substrate for forming the heat-resistant, corrosion-resistant, durable member for use in the sintering or heat treatment of powder metallurgical metals, cermets or ceramics is selected from among refractory metals (e.g., molybdenum, tantalum, tungsten, zirconium, and titanium), carbon, alloys thereof, oxide ceramics (e.g., alumina and mullite), carbide ceramics (e.g., silicon carbide and boron carbide) and nitride ceramics (e.g., silicon nitride).

In the third embodiment, an intermediate coating layer is formed on the substrate. The intermediate coating layers which can be used herein include:

(i) a layer of a lanthanoid oxide, an oxide of Y, Zr, Al or Si, a mixture of these oxides, or a complex oxide of these elements, (ii) a layer of a metal selected from among Mo, W, Nb, Zr, Ta, Si and B, or a carbide or nitride thereof, and (iii) a layer of $ZrO_2$, $Y_2O_3$, $Al_2O_3$ or a lanthanoid oxide, a mixture of these oxides, or a complex oxide of Zr, Y, Al or lanthanoid element, and a metal element selected from among Mo, W, Nb, Zr, Ta, Si and B.

In the intermediate coating layer (iii), the proportion of oxide and metal element, as expressed by [(oxides)/(oxides+metal elements)], is preferably from 30 to 70% by weight.

According to the invention, a topcoat layer is formed on the intermediate coating layer. If a topcoat layer is formed directly on a substrate without forming an intermediate coating layer, there is a case that when a cemented carbide-forming material is rested on the topcoat layer and sintered at 1,300 to 1,500° C. in vacuum or in an inert atmosphere or weakly reducing atmosphere, a likelihood of reaction between the substrate material and the topcoat layer arises depending on the sintering temperature and atmosphere. Particularly when carbon is used as the substrate material, reaction is likely to occur at temperatures above 1,400° C. Through reaction with carbon, aluminum oxide undergoes vigorous decomposition and evaporation and separates from the substrate. Some lanthanoid elements are likely to form carbides in vacuum. Once converted to a carbide, the oxide coating may readily peel from the substrate.

Then, for the purpose of inhibiting decomposition and evaporation or restraining carbide formation, an intermediate coating layer is formed on the carbon substrate as the interlayer using a refractory metal such as Mo, Ta, W or Si, a lanthanoid oxide which will not readily form a carbide with carbon, such as Eu or Yb oxide, or a mixture of a refractory metal and a lanthanoid oxide or another oxide such as $ZrO_2$ or $Al_2O_3$ as listed above in (i) to (iii). A topcoat layer (iv) to (vii) to be described later, for example, a coating layer of a complex oxide of Al and Y or a complex oxide of Al and lanthanoid, or a coating of lanthanoid oxide, aluminum oxide, zirconium oxide or yttrium oxide, or a coating of a compound or mixture thereof is formed on the intermediate coating layer for preventing separation at the carbon interface or preventing a cemented carbide product from sticking to the coated member.

The main component of the interlayer is desirably tungsten W for the metal layer or $Yb_2O_3$ and/or $ZrO_2$ for the oxide layer.

The provision of the intermediate coating layer (i) to (iii) of metal, oxide, carbide, nitride or the like enhances the interfacial bonding force to the substrate against repeated thermal cycling. When a refractory metal such as W or Si is used as the interlayer, the refractory metal reacts with the carbon substrate to form a carbide during heat treatment at 1,450° C. or higher. Specifically, tungsten converts to tungsten carbide WC, and silicon converts to silicon carbide SiC. In the case of Si, it converts to silicon nitride if treated in a nitrogen atmosphere. The conversion of the interface between the carbon substrate and the refractory metal to carbide or nitride significantly improves the bonding force to the substrate.

Further, the provision of the intermediate coating layer is effective for restraining decomposition and evaporation or carbide formation of $Y_2O_3$, lanthanoid oxides (e.g., $Gd_2O_3$) and $Al_2O_3$ which are likely to react with carbon in vacuum.

For the above reasons and other, it becomes possible to prevent sticking of the coated member to a product to be fired, evaporation of the topcoat layer, and separation of the topcoat layer from the substrate. Thus a coated jig having an oxide or complex oxide coating formed on the intermediate coating layer is available.

The lanthanoid oxide for use in the formation of the intermediate coating layer is an oxide of a rare earth element selected from among those having the atomic numbers 57 to 71. In addition to the rare earth oxide, an oxide of a metal selected from Groups 3A to 8 may be mixed or combined or laminated. Further preferably, an oxide of at least one metal selected from among Al, Si, Zr, Fe, Ti, Mn, V, and Y may be used.

In the invention, the topcoat layer is formed on the intermediate coating layer. The topcoat layers which can be used herein include:

(iv) a layer containing a complex oxide of a lanthanoid element and a Group 3B element, (v) a layer containing a complex oxide of yttrium and a Group 3B element, (vi) a layer containing a complex oxide of yttrium, a lanthanoid element and a Group 3B element, and (vii) a layer containing an oxide of a lanthanoid element, aluminum or yttrium.

The layer (iv) may further contain a lanthanoid oxide and/or a Group 3B element oxide; the layer (v) may further contain yttrium oxide and/or a Group 3B element oxide; and the layer (vi) may further contain yttrium oxide, a lanthanoid oxide or a Group 3B element oxide or a mixture of these oxides.

The lanthanoid elements are rare earth elements having the atomic numbers 57 to 71. The Group 3B elements designate B, Al, Ga, In and Tl. Formation of a complex oxide of these elements prevents the coated member from reacting with or sticking to a product being sintered. This is true particularly when a tungsten carbide material, a typical cemented carbide-forming material is fired, because reaction with tungsten or cobalt in the tungsten carbide is prevented and sticking is prevented. The risk of separation of the coating layer from the substrate as a result of sticking of the product is eliminated, and a coated member for firing having durability to thermal cycling is obtainable.

Among the Group 3B elements, a complex oxide of aluminum and yttrium is desirable. A complex oxide of aluminum and a lanthanoid element selected from among Sm, Eu, Gd, Dy, Er, Yb and Lu is especially desirable.

In the coating layers (iv) to (vi), the proportion of yttrium and/or lanthanoid element and Group 3B element, as expressed by (yttrium and/or lanthanoid element)/(yttrium and/or lanthanoid element+Group 3B element), is preferably 10 to 90% by weight. With too much Group 3B element, the bonding force of the coating layer to the substrate may be reduced by heat treatment, allowing the coating layer to separate. Too low a proportion of Group 3B element may allow the coating to seize the cemented carbide-forming material.

With respect to the weight proportion of the complex oxide of yttrium and aluminum, the complex oxide preferably consists of up to 80 wt % of $Y_2O_3$ component and at least 20 wt % of $Al_2O_3$ component. More preferably, the complex oxide consists of 70 to 30 wt % of $Y_2O_3$ component and 30 to 70 wt % of $Al_2O_3$ component. With more than 80 wt % of $Y_2O_3$ component, the coating is likely to seize the cemented carbide-forming material due to a reduced content of $Al_2O_3$ component. Too much $Al_2O_3$ component, the bonding force of the coating layer to the substrate may be extremely reduced by heat treatment, allowing the coating layer to separate.

The intermediate coating layer and topcoat layer are formed preferably by thermal spraying. That is, these coating layers can be formed as thermally sprayed films. The thermal spraying may be routinely carried out by well-known techniques. Source particles such as complex oxide, oxide or metal particles used to form the thermally sprayed films may have an average particle size of 10 to 70 μm. Source particles are plasma or flame sprayed onto the above-described substrate in an inert atmosphere of argon or nitrogen, thereby forming a coated member within the scope of the invention. If necessary, the surface of the substrate may be treated by a suitable technique such as blasting prior to the thermal spraying operation. It is also possible to subject the substrate surface to blasting, form an intermediate coating layer of a refractory metal, carbide or nitride on the substrate, subject the intermediate coating layer to blasting again, and form a topcoat layer of oxide or complex oxide thereon. Understandably, equivalent results are obtained by a coating technique other than thermal spraying, such as slurry coating.

The total thickness of the intermediate coating layer and topcoat layer is preferably from 0.02 mm to 0.4 mm, more preferably from 0.1 mm to 0.2 mm. A total thickness of less than 0.02 mm may leave a possibility of reaction between the substrate and the material to be sintered after repeated use. At a total thickness of more than 0.4 mm, thermal shock within the coated oxide film may cause the oxide to delaminate, possibly resulting in contamination of the product. The thickness of the intermediate coating layer is preferably ½ to 1/10, more preferably ⅓ to ⅕ of the total thickness because the intermediate coating layer in such a range exerts its effect to a full extent.

The heat resistant coated member produced in the foregoing manner according to the first to third embodiments of the invention may be used to effectively heat-treat or sinter powder metallurgical metals, cermets and ceramics at a temperature of up to 2,000° C., and preferably 1,000 to 1,800° C., for 1 to 50 hours. The heat treatment or sintering atmosphere is preferably a vacuum or an inert or reducing atmosphere.

Typically the coated member of the invention is used in the heat treatment (especially firing or sintering) of metals or ceramics as mentioned above. More specifically, a metal or ceramic material to be heat treated is placed on the coated member, whereupon the material is heated or sintered at a temperature in the above-described range, and in the case of the first or second embodiment, at a temperature of up to 1,800 C., especially 900 to 1,700° C., for 1 to 50 hours. The heat treating or sintering atmosphere is preferably a vacuum or an inert atmosphere having an oxygen partial pressure of not more than 0.01 MPa or a reducing atmosphere.

Exemplary metals and ceramics include chromium alloys, molybdenum alloys, tungsten carbide, silicon carbide, silicon nitride, titanium boride, silicon oxide, rare earth-aluminum complex oxides, rare earth-transition metal alloys, titanium alloys, rare earth oxides, and rare earth complex oxides. The coated members of the invention, typically in the form of jigs, are effective especially in the production of tungsten carbide, rare earth oxides, rare earth-aluminum complex oxides, and rare earth-transition metal alloys. More specifically, the coated members of the invention are effective in the production of magnetically permeable ceramics such as YAG and cemented carbides such as tungsten carbide, the production of Sm—Co alloys, Nd—Fe—B alloys and Sm—Fe—N alloys used in sintered magnets, and the production of Tb—Dy—Fe alloys used in sintered magnetostrictive materials and Er—Ni alloys used in sintered regenerators.

Examples of suitable inert atmospheres include argon and nitrogen ($N_2$) atmospheres. Examples of suitable reducing atmospheres include hydrogen gas, inert gas atmospheres in which a carbon heater is used, and inert gas atmospheres containing also several percent of hydrogen gas. An oxygen partial pressure of not more than 0.01 MPa ensures that the coated members are kept resistant to corrosion during the heat treating or sintering operation.

In addition to having a good heat resistance, the coated member of the invention also has a good corrosion resistance and non-reactivity, and can therefore be effectively used for sintering or heat-treating powder metallurgical metals, cermets or ceramics in a vacuum, an inert atmosphere or a reducing atmosphere. Where the surface layer of the rare earth-containing oxide coating has a Vickers hardness of at least 50 HV, the rare earth-containing oxide coating is prevented from peeling from the substrate. Where the oxide coating has a surface roughness of up to 20 μm in centerline average roughness Ra, it becomes effective for preventing a powder metallurgical metal, cermet or ceramic product from deforming during sintering or heat treatment.

EXAMPLE

The following examples and comparative examples are provided to illustrate the invention, and are not intended to limit the scope thereof.

Example I

Carbon substrates having dimensions of 50×50×5 mm were furnished. In Examples 1 to 6, the surface of the substrate was roughened by blasting, following which rare earth-containing oxide particles having the compositions and average particle sizes indicated in Table 1 were plasma-sprayed in argon/hydrogen onto the substrate surface, thereby coating the substrate with a layer of rare earth-containing oxide to form a coated member. Then the sprayed samples were heat treated in vacuum or in argon or roasted by an argon/hydrogen plasma flame, as indicated in Table 2.

In Examples 7 to 11, an oxide powder whose composition was shown in Table 1 was used and pressed into a preform having dimensions of 60×60×2–5 mm by a die pressing technique. The preform was then heat treated in an oxidizing atmosphere at 1700° C. for 2 hours, obtaining a plate of rare earth oxide. The plate was attached to the substrate to produce a rare earth oxide-covered member.

In Comparative Examples 1 and 2, coated members were similarly produced under the conditions shown in Tables 1 and 2.

The physical properties of the coated members were measured. The results are shown in Table 1. The compositions were measured using inductively coupled plasma spectroscopy (Seiko SPS-4000). The average particle sizes were measured by a laser diffraction method (Nikkiso FRA). The physical properties of the thermally sprayed coatings and heat treated preforms were also measured, with the results given below in Table 2. The thickness of the thermally sprayed coating was determined from a cross-sectional image of the coating taken with an optical microscope. The surface roughness Ra was measured with a surface roughness gauge (SE3500K; Kosaka Laboratory, Ltd.) in accordance with JIS B0601. The Vickers hardness was measured with a digital micro-hardness meter (Matsuzawa SMT-7) in accordance with JIS R1610, after the surface was mirror finished.

Next, a tungsten carbide powder was mixed with 10 wt % of a cobalt powder and the mixture was pressed into a compact having dimensions of 10×40×3 mm. The compact was rested on the rare earth oxide-coated member (jig) and sintered in a low vacuum at 1,400° C. for 2 hours. The sintering were conducted in a carbon heater furnace in such a pattern that the temperature was ramped up to 1,400° C. at a rate of 300° C./h, held at that temperature for a predetermined length of time, then lowered at a rate of 400° C./h. This sintering cycle was repeated twice, after which the coated member was examined for peeling of the rare earth oxide coating from the substrate, seizure of the coated member to the sample being sintered, and warpage of the sample. The results are shown in Table 3.

TABLE 1

| | Composition (weight ratio) | Average particle size (μm) | Substrate material | Substrate density (g/cm$^3$) |
|---|---|---|---|---|
| Example 1-3 | $Yb_2O_3$ | 40 | C | 1.7 |
| Example 4-6 | $Er_2O_3$ | 50 | C | 1.7 |
| Example 7 | $Yb_2O_3$ | 40 | C | 1.7 |
| Example 8 | $Dy_2O_3$ | 50 | C | 1.7 |
| Example 9 | $Sm_2O_3$ | 40 | C | 1.7 |
| Example 10 | $Gd_2O_3$ | 40 | C | 1.7 |
| Example 11 | $Gd_2O_3 + Al_2O_3$ (50:50) | 40 | C | 1.7 |
| Comparative Example 1 | $Al_2O_3$ | 40 | C | 1.7 |
| Comparative Example 2 | $Y_2O_3$ | 60 | C | 1.7 |

The jigs of Examples 1 to 11 remained unchanged after heat treatment in a carbon heater furnace relative to before treatment. On sintering, the samples did not seize to the jigs and deformed little. By contrast, following heat treatment in a carbon heater furnace, the jigs of Comparative Examples 1 and 2 underwent surface crazing or oxide delamination, leading to corrosion. In Comparative Example 1, the sample seized to the jig and deformed noticeably.

Example II

There were furnished matrix materials: carbon, molybdenum, tantalum, tungsten, aluminum, stainless steel, sintered alumina and sintered yttria (the latter two being oxide ceramics) having different coefficients of thermal expansion as shown in Table 4. The matrix materials were machined into substrates having dimensions of 50×50×5 mm. The surface of the substrate was roughened by blasting, following which rare earth-containing oxide particles were plasma-sprayed in argon/hydrogen onto the substrate surface, thereby forming a spray coated member with a rare earth-containing oxide coating of 200 μm thick.

It is noted that the coefficient of thermal expansion of substrate shown in Table 4 was measured on a prism specimen of 3×3×15 mm in an inert atmosphere according to a differential expansion method using a thermomechanical analyzer TMA8310 (Rigaku Denki K.K.). The measurement is an average coefficient of thermal expansion over the temperature range of 20 to 100° C.

In Examples 12-17 and 21-27 and Comparative Examples 3-5, a $Er_2O_3$ or $Yb_2O_3$ power was used in spraying. In Example 18, $Yb_2O_3$ powder and $Zr_2O_3$ powder were mixed in a $Yb_2O_3$:$Zr_2O_3$ weight ratio of 80 wt %:20 wt % to form a mixture, which was sprayed. In Example 19, a powder in which 90 wt % of $Yb_2O_3$ was chemically combined with 10 wt % of $Zr_2O_3$ was used in spraying. In Example 20, $Yb_2O_3$

TABLE 2

| | Coating layer | Coating thickness (mm) | Heat treating conditions | Before heat treatment Roughness Ra(μm) | Before heat treatment Hardness (HV) | After heat treatment Roughness Ra(μm) | After heat treatment Hardness (HV) |
|---|---|---|---|---|---|---|---|
| Example 1 | $Yb_2O_3$ sprayed | 0.20 | no | 7 | 80 | 7 | 80 |
| Example 2 | $Yb_2O_3$ sprayed | 0.15 | 1500° C. in vacuum | | | 5 | 100 |
| Example 3 | $Yb_2O_3$ sprayed | 0.30 | plasma flame in air | | | 2 | 200 |
| Example 4 | $Er_2O_3$ sprayed | 0.15 | no | 8 | 65 | 8 | 65 |
| Example 5 | $Er_2O_3$ sprayed | 0.20 | 1600° C. in Ar | | | 6 | 85 |
| Example 6 | $Er_2O_3$ sprayed | 0.20 | plasma flame in air | | | 3 | 160 |
| Example 7 | $Yb_2O_3$ preform | 5 | 1700° C. in air | 3 | 45 | 0.5 | 1015 |
| Example 8 | $Dy_2O_3$ preform | 3 | 1700° C. in air | 4 | 40 | 0.3 | 650 |
| Example 9 | $Sm_2O_3$ preform | 2 | 1700° C. in air | 6 | 38 | 1 | 205 |
| Example 10 | $Gd_2O_3$ preform | 4 | 1700° C. in air | 7 | 48 | 1.5 | 310 |
| Example 11 | $Gd_2O_3 + Al_2O_3$ preform | 5 | 1700° C. in air | 5 | 35 | 0.8 | 2130 |
| Comparative Example 1 | $Al_2O_3$ paste coated | 0.2 | no | 25 | 30 | 25 | 30 |
| Comparative Example 2 | $Y_2O_3$ preform | 3 | no | 5 | 40 | 5 | 40 |

TABLE 3

| | Coating layer appearance | Seizure of sample | Warpage of sample |
|---|---|---|---|
| Example 1 | no peeling | no | 0.2 mm |
| Example 2 | no peeling | no | 0.1 mm |
| Example 3 | no peeling | no | 0.1 mm |
| Example 4 | no peeling | no | 0.3 mm |
| Example 5 | no peeling | no | 0.2 mm |
| Example 6 | no peeling | no | 0.1 mm |
| Example 7 | no peeling | no | 0.1 mm |
| Example 8 | no peeling | no | 0.1 mm |
| Example 9 | no peeling | no | 0.1 mm |
| Example 10 | no peeling | no | 0.1 mm |
| Example 11 | no peeling | no | 0.2 mm |
| Comparative Example 1 | peeled | seized | 1 mm |
| Comparative Example 2 | crazed | no | 0.5 mm |

powder was sprayed to form a coating of 100 μm thick, after which a $Y_2O_3$ coating of 100 μm thick was formed thereon by spraying.

These spray coated members based on the substrates having different coefficients of thermal expansion were set in a carbon heater furnace. The furnace was evacuated to vacuum, heated in a nitrogen atmosphere up to 800° C. at a rate of 400° C./h, evacuated to vacuum again, and heated in a vacuum atmosphere of $10^{-2}$ Torr up to a predetermined temperature at a rate of 400° C./h. After holding at the temperature for a certain time, the heater was turned off. Argon was introduced at 1000° C., after which the furnace was cooled down to room temperature at a rate of 500° C./h. This heating and cooling cycle was repeated 10 times. After the thermal cycling test, the coated members were observed under a microscope with a magnifying power of 100× to see whether the sprayed coating peeled from the substrate. The results are shown in Table 5.

TABLE 4

| | Sprayed coating composition | Substrate material | Substrate density ($g/cm^3$) | Substrate coefficient of thermal expansion (1/K) |
|---|---|---|---|---|
| Example 12 | $Er_2O_3$ | C | 1.70 | $4.2 \times 10^{-6}$ |
| Example 13 | $Er_2O_3$ | C | 1.75 | $5.2 \times 10^{-6}$ |
| Example 14 | $Er_2O_3$ | C | 1.82 | $6 \times 10^{-6}$ |
| Example 15 | $Yb_2O_3$ | C | 1.70 | $4.2 \times 10^{-6}$ |
| Example 16 | $Yb_2O_3$ | C | 1.75 | $5.2 \times 10^{-6}$ |
| Example 17 | $Yb_2O_3$ | C | 1.82 | $6 \times 10^{-6}$ |
| Example 18 | $Yb_2O_3 + Zr_2O_3$ (80 wt %:20 wt %) | C | 1.82 | $6 \times 10^{-6}$ |
| Example 19 | $Yb_2O_3 + Al_2O_3$ (90 wt %:10 wt %) | C | 1.70 | $4.2 \times 10^{-6}$ |
| Example 20 | upper $Y_2O_3$/ lower $Yb_2O_3$ (100 μm/100 μm) | C | 1.75 | $5.2 \times 10^{-6}$ |
| Example 21 | $Yb_2O_3$ | Mo | 10.2 | $5.3 \times 10^{-6}$ |
| Example 22 | $Yb_2O_3$ | Ta | 16.6 | $6.3 \times 10^{-6}$ |
| Example 23 | $Yb_2O_3$ | W | 19.1 | $4.5 \times 10^{-6}$ |
| Example 24 | $Yb_2O_3$ | Al | 2.7 | $23.1 \times 10^{-6}$ |
| Example 25 | $Yb_2O_3$ | stainless steel | 8.2 | $14.7 \times 10^{-6}$ |
| Example 26 | $Yb_2O_3$ | sintered $Al_2O_3$ | 3.97 | $8.6 \times 10^{-6}$ |
| Example 27 | $Yb_2O_3$ | sintered $Y_2O_3$ | 4.50 | $9.3 \times 10^{-6}$ |
| Comparative Example 3 | $Er_2O_3$ | C | 1.74 | $1.5 \times 10^{-6}$ |
| Comparative Example 4 | $Yb_2O_3$ | C | 1.74 | $1.5 \times 10^{-6}$ |
| Comparative Example 5 | $Yb_2O_3$ | C | 1.60 | $2.5 \times 10^{-6}$ |

TABLE 5

| | Test temp. (° C.) | Holding time (hr) | 1st | 2nd | 3rd | 4th | 5th | 6th | 7th | 8th | 9th | 10th | Observation after thermal cycling test of 10 cycles |
|---|---|---|---|---|---|---|---|---|---|---|---|---|---|
| EX 12 | 1400 | 4 | pass | pass | pass | pass | pass | pass | pass | pass | pass | pass | not peeled |
| EX 13 | 1400 | 4 | pass | pass | pass | pass | pass | pass | pass | pass | pass | pass | not peeled |
| EX 14 | 1400 | 4 | pass | pass | pass | pass | pass | pass | pass | pass | pass | pass | not peeled |
| EX 15 | 1500 | 4 | pass | pass | pass | pass | pass | pass | pass | pass | pass | pass | not peeled |
| EX 16 | 1500 | 4 | pass | pass | pass | pass | pass | pass | pass | pass | pass | pass | not peeled |
| EX 17 | 1500 | 4 | pass | pass | pass | pass | pass | pass | pass | pass | pass | pass | not peeled |
| EX 18 | 1500 | 4 | pass | pass | pass | pass | pass | pass | pass | pass | pass | pass | not peeled |
| EX 19 | 1500 | 4 | pass | pass | pass | pass | pass | pass | pass | pass | pass | pass | not peeled |
| EX 20 | 1500 | 4 | pass | pass | pass | pass | pass | pass | pass | pass | pass | pass | not peeled |
| EX 21 | 1600 | 4 | pass | pass | pass | pass | pass | pass | pass | pass | pass | pass | not peeled |
| EX 22 | 1600 | 4 | pass | pass | pass | pass | pass | pass | pass | pass | pass | pass | not peeled |
| EX 23 | 1600 | 4 | pass | pass | pass | pass | pass | pass | pass | pass | pass | pass | not peeled |
| EX 24 | 500 | 4 | pass | pass | pass | pass | pass | pass | pass | pass | pass | pass | not peeled |
| EX 25 | 900 | 4 | pass | pass | pass | pass | pass | pass | pass | pass | pass | pass | not peeled |
| EX 26 | 1400 | 4 | pass | pass | pass | pass | pass | pass | pass | pass | pass | pass | not peeled |
| EX 27 | 1500 | 4 | pass | pass | pass | pass | pass | pass | pass | pass | pass | pass | not peeled |
| CE 3 | 1400 | 4 | pass | pass | reject | reject | reject | reject | reject | reject | reject | reject | peeled in 3rd cycle |
| CE 4 | 1500 | 4 | pass | pass | pass | pass | pass | reject | reject | reject | reject | reject | peeled in 6th cycle |
| CE 5 | 1500 | 4 | pass | pass | pass | pass | pass | pass | pass | pass | reject | reject | peeled in 9th cycle |

The spray coated members of Examples 12 to 27 remained unchanged after the thermal cycling test of 10 cycles in vacuum in a carbon heater furnace relative to before treatment, with no evidence of peeling of the coating from the substrate observed. In the coated members of Comparative Examples 3 to 5, the coating peeled from the substrate during the thermal cycling test. It is demonstrated that when a coating is sprayed on a substrate having a coefficient of thermal expansion of at least $4\times10^{-6}$ (1/K), the coated member is durable in that the coating do not peel from the substrate during thermal cycling.

Example III

There were furnished matrix materials: carbon, molybdenum, alumina ceramic, mullite ceramic and silicon carbide. The matrix materials were machined into substrates having dimensions of 50×50×5 mm. The surface of the substrate was roughened by blasting. In Comparative Examples 6-10, complex oxide particles containing yttrium or lanthanoid element and aluminum were plasma-sprayed in argon/hydrogen onto the substrate surface, thereby forming a spray coated member with an oxide coating of 100 μm thick.

To prevent reaction with the carbon substrate and to enhance the bonding force to the substrate, in Examples 28-32, tungsten or silicon particles were plasma-sprayed in argon/hydrogen as an interlayer to form a metal coating of 50 μm thick. On the metal coating, $Yb_2O_3$ particles, $Gd_2O_3$ particles, or complex oxide particles containing Y, Yb or Gd and Al were plasma-sprayed in argon/hydrogen, thereby forming a dual spray coated member having a total coating thickness of 100 μm.

In Examples 33-39, particles of Y, Yb or Zr oxide, or a mixture of particles of Yb or Al oxide and metallic W particles were plasma-sprayed in argon/hydrogen to form a coating of 50 μm thick. On the coating, $Yb_2O_3$ particles, $Gd_2O_3$ particles, or complex oxide particles containing Yb, Gd or Y and Al were plasma-sprayed in argon/hydrogen, thereby forming a dual spray coated member having a total coating thickness of 100 μm.

In Comparative Examples 11-13, spray coated members having a coating thickness of 100 μm were prepared in the same manner as in Comparative Examples 6-10 except that $Y_2O_3$ particles, $Al_2O_3$ particles, or particles of Y+Zr were used.

In Comparative Example 14, tungsten particles were plasma-sprayed in argon/hydrogen to form a metal coating of 50 μm thick. On the metal coating, $Y_2O_3$ particles were plasma-sprayed in argon/hydrogen, thereby forming a dual spray coated member having a total coating thickness of 100 μm.

The thickness of sample coating films was measured by sectioning the coating, polishing the section, and observing under an electron microscope with a low magnifying power.

The samples of Examples 28-39 and Comparative Examples 6-14 were heated in a vacuum atmosphere of $10^{-2}$ Torr to a temperature of 1,550° C. at a rate of 400° C./h. After holding at the temperature for 2 hours, the heater was turned off. Argon was introduced at 1000° C., after which the furnace was cooled down to room temperature at a rate of 500° C./h.

Next, a tungsten carbide powder was mixed with 10 wt % of a cobalt powder and the mixture was pressed into a compact having a diameter of 20 mm and a thickness of 10 mm. The compact was rested on the coated member which had been heat treated at 1,550° C. This was placed in a carbon heater furnace. The furnace was evacuated to vacuum, heated in a nitrogen atmosphere up to 800° C. at a rate of 400° C./h, evacuated to vacuum again, and heated in a vacuum atmosphere of $10^{-2}$ Torr up to a predetermined temperature at a rate of 400° C./h. After holding at the temperature for 2 hours, the heater was turned off. Argon was introduced at 1000° C., after which the furnace was cooled down to room temperature at a rate of 500° C./h. This heating and cooling cycle was repeated 5 times, provided that a fresh compact was rested on the coated member on the start of each cycle. After the thermal cycling test, the coated members were observed to see whether the sprayed complex oxide coating peeled from the substrate due to seizure of the compact being fired. The results are shown in Table 7.

TABLE 6

| | Topcoat composition | Intermediate coating layer composition | Substrate material |
|---|---|---|---|
| Example 28 | $Yb_2O_3$ (100 wt %) | W (100 wt %) | C |
| Example 29 | $Gd_2O_3$ (100 wt %) | W (100 wt %) | C |
| Example 30 | $Y_2O_3 + Al_2O_3$ (50 wt % + 50 wt %) | W (100 wt %) | C |
| Example 31 | $Gb_2O_3 + Al_2O_3$ (70 wt % + 30 wt %) | W (100 wt %) | C |
| Example 32 | $Yb_2O_3 + Al_2O_3$ (50 wt % + 50 wt %) | Si (100 wt %) | C |
| Example 33 | $Y_2O_3 + Al_2O_3$ (50 wt % + 50 wt %) | $Yb_2O_3$ (100 wt %) | C |
| Example 34 | $Yb_2O_3$ (100 wt %) | $Y_2O_3$ (100 wt %) | C |
| Example 35 | $Gd_2O_3 + Al_2O_3$ (60 wt % + 40 wt %) | $Yb_2O_3$ (100 wt %) | C |
| Example 36 | $Yb_2O_3 + Al_2O_3$ (50 wt % + 50 wt %) | $Y_2O_3 + ZrO_2$ (70 wt % + 30 wt %) | C |
| Example 37 | $Y_2O_3 + Al_2O_3$ (70 wt % + 30 wt %) | $Yb_2O_3$ + W (40 wt % + 60 wt %) | C |
| Example 38 | $Gd_2O_3 + Al_2O_3$ (50 wt % + 50 wt %) | $A1_2O_3$+ W (60 wt % + 40 wt %) | C |
| Example 39 | $Gd_2O_3$ (100 wt %) | $Yb_2O_3$ (100 wt %) | C |
| Comparative Example 6 | $Y_2O_3 + Al_2O_3$ (50 wt % + 50 wt %) | no | C |
| Comparative Example 7 | $Yb_2O_3 + Al_2O_3$ (70 wt % + 30 wt %) | no | Mo |
| Comparative Example 8 | $Gd_2O_3 + Al_2O_3$ (60 wt % + 40 wt %) | no | alumina |
| Comparative Example 9 | $Lu_2O_3 + Al_2O_3$ (60 wt % + 40 wt %) | no | mullite |
| Comparative Example 10 | $Er_2O_3 + Al_2O_3$ (40 wt % + 60 wt %) | no | SiC |
| Comparative Example 11 | $Y_2O_3$ (100 wt %) | no | C |
| Comparative Example 12 | $Al_2O_3$ (100 wt %) | no | C |
| Comparative Example 13 | $Y_2O_3 + ZrO_2$ (70 wt % + 30 wt %) | no | C |
| Comparative Example 14 | $Y_2O_3$ (100 wt %) | W (100 wt %) | C |

TABLE 7

| | Sintering temp. (° C.) | 1st | 2nd | 3rd | 4th | 5th | Observation after thermal cycling test |
|---|---|---|---|---|---|---|---|
| Example 28 | 1,450 | pass | pass | pass | pass | pass | not peeled |
| Example 29 | 1,450 | pass | pass | pass | pass | pass | not peeled |
| Example 30 | 1,450 | pass | pass | pass | pass | pass | not peeled |
| Example 31 | 1,450 | pass | pass | pass | pass | pass | not peeled |
| Example 32 | 1,450 | pass | pass | pass | pass | pass | not peeled |
| Example 33 | 1,450 | pass | pass | pass | pass | pass | not peeled |
| Example 34 | 1,450 | pass | pass | pass | pass | pass | not peeled |
| Example 35 | 1,450 | pass | pass | pass | pass | pass | not peeled |
| Example 36 | 1,450 | pass | pass | pass | pass | pass | not peeled |
| Example 37 | 1,450 | pass | pass | pass | pass | pass | not peeled |
| Example 38 | 1,450 | pass | pass | pass | pass | pass | not peeled |
| Example 39 | 1,450 | pass | pass | pass | pass | pass | not peeled |
| Comparative Example 6 | 1,350 | pass | pass | reject | reject | reject | peeled in 3rd cycle |
| Comparative Example 7 | 1,350 | pass | pass | reject | reject | reject | peeled in 3rd cycle |
| Comparative Example 8 | 1,350 | pass | pass | reject | reject | reject | peeled in 3rd cycle |
| Comparative Example 9 | 1,350 | pass | pass | reject | reject | reject | peeled in 3rd cycle |
| Comparative Example 10 | 1,350 | pass | pass | reject | reject | reject | peeled in 3rd cycle |
| Comparative Example 11 | 1,350 | reject | reject | reject | reject | reject | peeled in 1st cycle |
| Comparative Example 12 | 1,350 | reject | reject | reject | reject | reject | peeled in 1st cycle |
| Comparative Example 13 | 1,350 | reject | reject | reject | reject | reject | peeled in 1st cycle |
| Comparative Example 14 | 1,450 | pass | pass | reject | reject | reject | peeled in 3rd cycle |

In the spray coated members of Examples 28-39, no delamination of the coating was observed after five consecutive tests of sintering WC/Co cemented carbide in a vacuum atmosphere in a carbon heater furnace. In contrast, in the spray coated members of Comparative Examples 6-14, delamination of the coating occurred in five consecutive sintering tests due to seizure of WC/Co specimens. It is thus demonstrated that a spray coated member in the form of a substrate coated with a layer containing a complex oxide of yttrium, lanthanoid and aluminum is durable because the peeling of the sprayed coating caused by seizure of WC/Co cemented carbide specimens is minimized. Durability is further enhanced using an interlayer containing a refractory metal, a lanthanoid oxide or a mixture of a refractory metal and a lanthanoid oxide.

Example IV

To examine how the durability of a coated member is affected by the coefficient of thermal expansion of a substrate and the hardness and composition of an upper coating layer, a thermal cycling test simulating the sintering of cemented carbide material was carried out for observing whether the coating layer was peeled. The test and its results are described below.

There were furnished carbon matrix materials having different coefficients of thermal expansion as shown in Table 8. The matrix materials were machined into substrates having dimensions of 50×50×5 mm. The surface of the substrate was roughened by blasting. Oxide particles were plasma-sprayed in argon/hydrogen onto the substrate surface and heat treated, thereby forming a spray coated member with a coating of 100 μm thick having a certain hardness and roughness (Examples 40-43 and Comparative Examples 17-19). In Comparative Examples 15 and 16, an oxide powder was combined with a binder and water to form a paste, which was coated onto the substrate surface to form a coated member with a coating having a certain hardness and roughness.

The samples of Examples 40-43 and Comparative Examples 15-19 were heated in a vacuum atmosphere of $10^{-2}$ Torr to a temperature of 1,550° C. at a rate of 400° C./h. After holding at the temperature for 2 hours, the heater was turned off. Argon was introduced at 1000° C., after which the furnace was cooled down to room temperature at a rate of 500° C./h. This procedure was intended for water removal and for preventing premature peeling of the coating layer.

Next, a tungsten carbide powder was mixed with 10 wt % of a cobalt powder and the mixture was pressed into a cemented carbide-forming compact having a diameter of 20 mm and a thickness of 10 mm. The compact was rested on the coated member which had been heat treated at 1,550° C. This was placed in a carbon heater furnace. The furnace was evacuated to vacuum, heated in a nitrogen atmosphere up to 800° C. at a rate of 400° C./h, evacuated to vacuum again, and heated in a vacuum atmosphere of $10^{-2}$ Torr up to 1,450° C. (sintering temperature for cemented carbide) at a rate of 400° C./h. After holding at the temperature for 2 hours, the heater was turned of f. Argon was introduced at 1000° C., after which the furnace was cooled down to room temperature at a rate of 500° C./h. This heating and cooling cycle was repeated 10 times, provided that a fresh compact was rested on the coated member on the start of each cycle. After the thermal cycling test, the coated members were observed to see whether the coating layer peeled from the substrate. The results are shown in Table 9.

The coating layer peels through the following mechanism. Cobalt exudes from the bottom of the cemented carbide sample at the sintering temperature of 1,450° C. and subsequently catches the coating layer during cooling for solidification, whereby the cemented carbide sample and the coating layer are seized together. When the cemented carbide sample is taken out of the coated member (jig) after resumption to room temperature, the coating layer is peeled so that the underlying carbon surface is exposed.

Example 40 and Comparative Examples 15 and 16 are to examine how durability varies with the hardness of the upper coating layer. For the same material ($Yb_2O_3$), the higher the hardness of the upper coating layer, the better became the durability. Equivalent results were obtained from the other material ($Al_2O_3$).

Example 41 and Comparative Example 17 are to examine how durability varies with the coefficient of thermal expansion of the substrate when the upper coating layer has the same hardness. For the same material ($Yb_2O_3$) and the same hardness, the higher the coefficient of thermal expansion of the substrate, the better became the durability.

Examples 42 and 43 and Comparative Examples 18 and 19 are to examine how durability varies with the presence or absence of the intermediate coating layer and with the composition of the coating layer. Those coated members having an intermediate coating layer of $Yb_2O_3$ or $ZrO_2$ and an upper coating layer of $Y_2O_3$+$Al_2O_3$ were fully durable in that no peeling occurred after ten thermal cycling tests.

It is evident that by using an upper coating layer having a high hardness and a substrate having a high coefficient of thermal expansion, and selecting as the upper coating layer a material unsusceptible to seizure of samples to be sintered, a carbon-base setter is obtainable which remains durable when used in the sintering of cemented carbide samples to be sintered at high temperatures of at least 1400° C.

TABLE 8

| | Upper coating layer (weight ratio) | Intermediate coating layer (weight ratio) | Upper coating layer hardness (HV) | Upper coating layer roughness Ra (μm) | Substrate | Substrate's coefficient of thermal expansion |
|---|---|---|---|---|---|---|
| Example 40 | sprayed $Yb_2O_3$ (100 wt %) | — | 80 | 7 | C | $4.2 \times 10^{-6}$ |
| Comparative Example 15 | paste coated $Yb_2O_3$ (100 wt %) | — | 35 | 10 | C | $4.2 \times 10^{-6}$ |
| Comparative Example 16 | paste coated $Al_2O_3$ (100 wt %) | — | 30 | 25 | C | $4.2 \times 10^{-6}$ |
| Example 41 | sprayed $Yb_2O_3$ (100 wt %) | — | 80 | 7 | C | $6 \times 10^{-6}$ |
| Comparative Example 17 | sprayed $Yb_2O_3$ (100 wt %) | — | 80 | 7 | C | $1.5 \times 10^{-6}$ |
| Example 42 | sprayed $Y_2O_3 + Al_2O_3$ (50 + 50 wt %) | sprayed $Yb_2O_3$ (100 wt %) | 100 | 6 | C | $6 \times 10^{-6}$ |
| Example 43 | sprayed $Y_2O_3 + Al_2O_3$ (30 + 70 wt %) | sprayed $ZrO_2$ (100 wt %) | 100 | 6 | C | $6 \times 10^{-6}$ |
| Comparative Example 18 | sprayed $Y_2O_3 + Al_2O_3$ (50 + 50 wt %) | — | 100 | 6 | C | $6 \times 10^{-6}$ |
| Comparative Example 19 | sprayed $Y_2O_3$ (100 wt %) | sprayed W (100 wt %) | 100 | 6 | C | $6 \times 10^{-6}$ |

TABLE 9

| | Sintering temp. (° C.) | 1st | 2nd | 3rd | 4th | 5th | 10th | Peeling after thermal cycling tests |
|---|---|---|---|---|---|---|---|---|
| Example 40 | 1450 | pass | pass | pass | pass | reject | reject | peeled in 5th test |
| Comparative Example 15 | 1450 | reject | — | — | — | — | — | peeled in 1st test |
| Comparative Example 16 | 1450 | reject | — | — | — | — | — | peeled in 1st test |
| Example 41 | 1450 | pass | pass | pass | pass | pass | pass | peeled in 7th test |
| Comparative Example 17 | 1450 | pass | pass | reject | — | — | — | peeled in 3rd test |
| Example 42 | 1450 | pass | pass | pass | pass | pass | pass | not peeled |
| Example 43 | 1450 | pass | pass | pass | pass | pass | pass | not peeled |
| Comparative Example 18 | 1450 | pass | pass | reject | — | — | — | peeled in 3rd test |
| Comparative Example 19 | 1450 | pass | pass | reject | — | — | — | peeled in 3rd test |

Japanese Patent Application Nos. 2002-336769, 2002-356171 and 2003-089797 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A heat resistant coated member comprising:

a substrate made of a material selected from the group consisting of Mo, Ta, W, Zr, and carbon; and a coating of rare earth-containing oxide thereon, the rare earth-containing oxide coating including a surface layer having a hardness of at least 50 HV in Vickers hardness.

2. The coated member of claim 1, wherein the rare earth-containing oxide coating has a surface roughness of up to 20 μm in centerline average roughness Ra.

3. A heat resistant coated member comprising:

a substrate having a coefficient of linear expansion of at least $4\times10^{-6}$ (1/K); and a layer comprising rare earth-containing oxide coated thereon.

4. The coated member of claim 3, wherein the coating layer comprises at least 80% by weight of a rare earth oxide and the balance of another metal oxide which is mixed, combined or laminated therewith.

5. The coated member of claim 3, wherein the rare earth oxide is mainly composed of an oxide of at least one element selected from the group consisting of Dy, Ho, Er, Tm, Yb, Lu, and Gd.

6. The coated member of claim 3, wherein said coating layer has a thickness of 0.02 mm to 0.4 mm.

7. The coated member of claim 3, wherein said coating layer has been formed by thermal spraying.

8. The coated member of claim 3, which is used in the sintering of a powder metallurgical metal, cermet or ceramic material in vacuum or an inert or reducing atmosphere.

9. A heat resistant coated member comprising:

a substrate having a coefficient of linear expansion of at least $4\times10^{31\ 6}$ (1/K); and a layer consisting of rare earth oxide coated thereon.

10. A heat resistant coated member comprising:

a metal, carbon, or carbide, nitride or oxide ceramic substrate;

an intermediate coating layer on the substrate comprising a lanthanoid oxide, an oxide of Y, Zr, Al or Si, a mixture of these oxides, or a complex oxide of these elements; and a coating layer on the intermediate coating layer comprising a complex oxide of yttrium and a Group 3B element, or a complex oxide of yttrium, a lanthanoid and a Group 3B element.

11. The coated member of claim 10, wherein the complex oxide of yttrium and a Group 3B element contains up to 80% by weight of $Y_2O_3$ and at least 20% by weight of $A1_2O_3$.

12. A heat resistant coated member comprising:

a metal, carbon, or carbide, nitride or oxide ceramic substrate;

an intermediate coating layer on the substrate comprising a metal selected from the group consisting of Mo, W, Nb, Zr, Ta, Si and B, or a carbide or nitride thereof; and a coating layer on the intermediate coating layer comprising a complex oxide of yttrium and a Group 3B element, or a complex oxide of yttrium, a lanthanoid and a Group 3B element.

13. A heat resistant coated member comprising:

a metal, carbon, or carbide, nitride or oxide ceramic substrate;

an intermediate coating layer on the substrate comprising $ZrO_2$, $Y_2O_3$, $Al_2O_3$ or a lanthanoid oxide, a mixture of these oxides, or a complex oxide of Zr, Y, Al or lanthanoid element, and a metal selected from the group consisting of Mo, W, Nb, Zr, Ta, Si and B; and a coating layer on the intermediate coating layer comprising a complex oxide of yttrium and a Group 3B element, or a complex oxide of yttrium, a lanthanoid and a Group 3B element.

14. A heat resistant coated member comprising:

a metal, carbon, or carbide, nitride or oxide ceramic substrate;

an intermediate coating layer on the substrate comprising a lanthanoid oxide, an oxide of Y, Zr, Al or St a mixture of these oxides, or a complex oxide of these elements; and a coating layer on the intermediate coating layer comprising an oxide of a lanthanoid element, aluminum or yttrium.

15. A heat resistant coated member comprising:

a carbon substrate, an interlayer of $Yb_2O_3$ formed thereon; and a coating layer formed on the interlayer and comprising a complex oxide consisting essentially of up to 80% by weight of $Y_2O_3$ and at least 20% by weight of $Al_2O_3$.

16. A heat resistant coated member comprising:

a carbon substrate, an interlayer of $ZrO_2$ formed thereon; and a coating layer formed on the interlayer and comprising a complex oxide consisting essentially of up to 80% by weight of $Y_2O_3$ and at least 20% by weight of $Al_2O_3$.

17. A heat resistant coated member comprising:

a carbon substrate, an interlayer of $ZrO_2$ and $Y_2O_3$ formed thereon; and a coating layer formed on the interlayer and comprising a complex oxide consisting essentially of up to 80% by weight of $Y_2O_3$ and at least 20% by weight of $Al_2O_3$.

18. A heat resistant coated member comprising:

a carbon substrate, an interlayer of tungsten formed thereon; and a coating layer formed on the interlayer and comprising a complex oxide consisting essentially of up to 80% by weight of $Y_2O_3$ and at least 20% by weight of $Al_2O_3$.

* * * * *